US009695678B2

(12) United States Patent
Webber et al.

(10) Patent No.: US 9,695,678 B2
(45) Date of Patent: Jul. 4, 2017

(54) SUBTERRANEAN HYDRAULIC JACK

(71) Applicant: BAKER HUGHES INCORPORATED, Houston, TX (US)

(72) Inventors: Andrew Webber, Cypress, TX (US); Drayton W. Bryant, Houston, TX (US); Santos Manzano, Cypress, TX (US); Evan Williams, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 392 days.

(21) Appl. No.: 14/298,646

(22) Filed: Jun. 6, 2014

(65) Prior Publication Data

US 2015/0354324 A1 Dec. 10, 2015

(51) Int. Cl.

| | |
|---|---|
| ***E21B 43/12*** | (2006.01) |
| ***E21B 19/06*** | (2006.01) |
| ***E21B 34/10*** | (2006.01) |
| ***E21B 41/00*** | (2006.01) |
| ***E21B 23/04*** | (2006.01) |
| ***E21B 34/14*** | (2006.01) |
| ***E21B 43/10*** | (2006.01) |

(52) U.S. Cl.

CPC ..... *E21B 43/12* (2013.01); *E21B 19/06* (2013.01); *E21B 23/04* (2013.01); *E21B 34/10* (2013.01); *E21B 34/14* (2013.01); *E21B 41/0021* (2013.01); *E21B 43/10* (2013.01)

(58) Field of Classification Search

CPC ..... E21B 43/12; E21B 19/06; E21B 23/04; E21B 34/10; E21B 34/14; E21B 41/0021; E21B 43/10

See application file for complete search history.

(56) References Cited

U.S. PATENT DOCUMENTS

2008/0017420 A1* 1/2008 Law ..... E21B 17/076 175/321

* cited by examiner

*Primary Examiner* — Yong-Suk (Philip) Ro
(74) *Attorney, Agent, or Firm* — Steve Rosenblatt

(57) ABSTRACT

A system and method allows the operation of a remotely located tool in an application where there is a telescoping space out joint in such a manner that the hanger need not be released. A hydraulic piston is surface actuated to move gripping teeth against the pipe and then take the pipe with the gripping teeth so that a tool that is engaged by the string can be remotely operated while safety features for the well can remain operative. The shifted position is held with maintained control line pressure. Some release of the control line pressure will not allow the operating piston to return. Rather, a check valve holds the shifted piston position until a differential pressure on the check valve drops to a predetermined value so that the check valve acts as a dump valve. The system operates off annulus pressure if the control line is damaged.

20 Claims, 3 Drawing Sheets

SUBTERRANEAN HYDRAULIC JACK

FIELD OF THE INVENTION

The field of the invention is tubular lifting devices and more particularly those that allow a safety device such as a tubing hanger to remain set while a subterranean device is operated.

BACKGROUND OF THE INVENTION

Situations arise when using a telescoping space out joint (TSOJ) that require raising the tubing string with the hanger released the extent of the stroke of the TSOJ before the desired movement at a subterranean location can be obtained. In these situations there is a safety feature that has to be disabled to get the actuation to happen at a remote location. Thus a possibility of loss of well control occurs such as for example when trying to close a barrier valve with a shifting tool with the hanger unset and the valve still not fully closed. This problem is illustrated in FIGS. 1-4. A cased borehole 10 has a packer 12 and a barrier valve 14 suspended by the packer 12. The barrier valve 14 is run in open and the packer 12 is set as shown in FIG. 1. In FIG. 2 that assembly of a tubing string 16 with a hanger 18 is run in with a TSOJ 20 that has a shifting tool 22 at the lower end. In FIG. 3 the liner hanger 18 is schematically shown as set by showing it in contact with the casing 10. The TSOJ 22 compensates for the component spacing from the hanger 18 in the set location. Compensation for spacing is achieved when 24 and 26 separate to leave the barrier valve 14 still in the open position. The problem is best seen in FIG. 4 when it is time to close the barrier valve 14. The hanger 18 has to be released and then picked up to bring surfaces 24 and 26 together before any movement of the shifting tool occurs so that the barrier valve 14 can close. In FIG. 4 that hanger 18 is released and still needs to be raised more before the shifting tool 22 will put the barrier valve 14 into a closed position.

The present invention addresses this problem when a TSOJ is used by allowing the hanger to remain set and adding a hydraulic actuator to lift the shifting tool with the hanger remaining fixed. A control line powers a piston to selectively grab the pipe and raise it to close a barrier valve or some other tool. The actuated position is held with a check valve that responds to pressure differential to act as a dump valve. This allows holding the shifting tool in the shifted position by maintaining control line pressure and allowing the shifting tool to come back down by venting the control line pressure to a predetermined differential pressure across the check valve to allow it to vent. These and other features of the present invention will be more readily understood by those skilled in the art from a review of the description of the preferred embodiment and the associated drawings while recognizing that the full scope of the invention is to be determined by the appended claims.

SUMMARY OF THE INVENTION

A system and method allows the operation of a remotely located tool in an application where there is a telescoping space out joint in such a manner that the hanger need not be released. A hydraulic piston is surface actuated to move gripping teeth against the pipe and then take the pipe with the gripping teeth so that a tool that is engaged by the string can be remotely operated while safety features for the well can remain operative. The shifted position is held with maintained control line pressure. Some release of the control line pressure will not allow the operating piston to return. Rather, a check valve holds the shifted piston position until a differential pressure on the check valve drops to a predetermined value so that the check valve acts as a dump valve. The system operates off annulus pressure if the control line is damaged.

BRIEF DESCRIPTION OF THE DRAWINGS

FIG. 2 is the view of FIG. 1 showing a string with a telescoping space out joint being run in;

DETAILED DESCRIPTION OF THE PREFERRED EMBODIMENT

Figure 1:
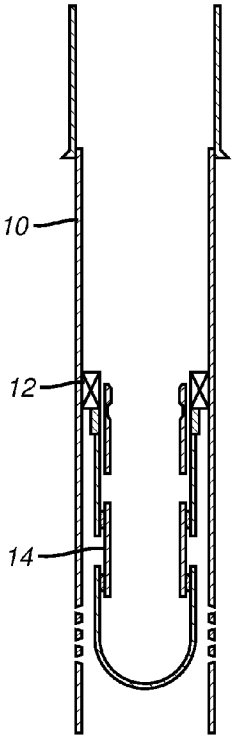
(PRIOR ART) FIG. 1
FIG. 1 is a prior art view of a set packer with a barrier valve in the closed position.
Figure 2:
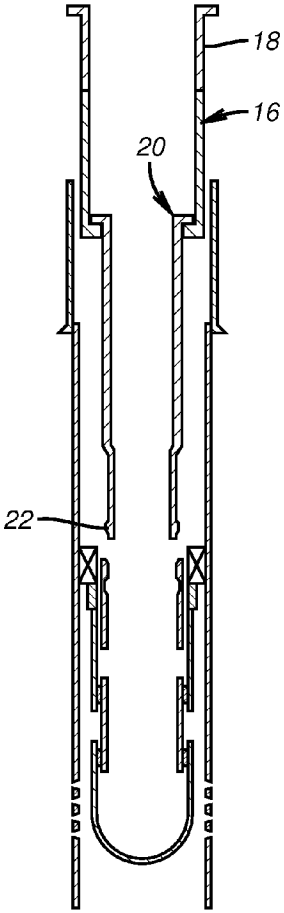
(PRIOR ART) FIG. 2
Figure 3:
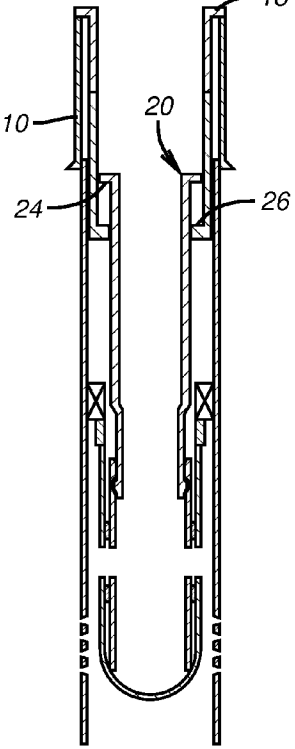
(PRIOR ART) FIG. 3
FIG. 3 is the view of FIG. 2 with the sleeve on the barrier valve latched and shifted to open and the hanger set to the casing.
Figure 4:
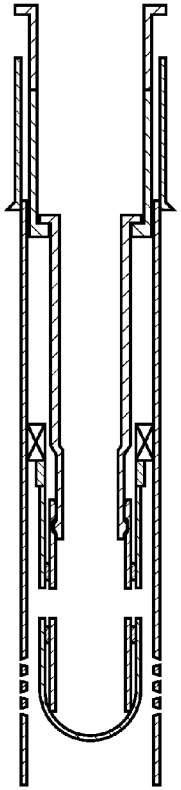
(PRIOR ART) FIG. 4
FIG. 4. is the view of FIG. 3 showing that the hanger has to be released with the barrier valve open to pick up enough to take the slack out of the telescoping joint before the barrier valve can be closed.
Figure 6:
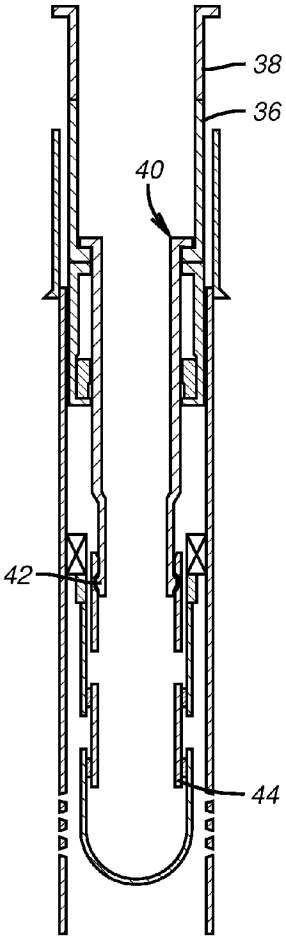
FIG. 6 is the view of FIG. 5 showing the introduction of a string with a telescoping space out joint and a powered jack that can raise the string without needing to release the hanger.
Figure 5:
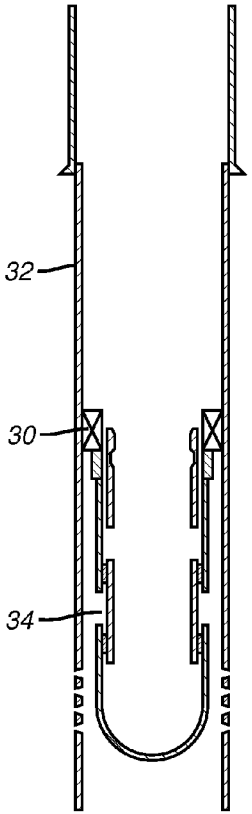
FIG. 5 shows the present invention in context of a set packer with a barrier valve.

FIG. 5 shows the packer 30 set against the casing 32 with the barrier valve 34 supported below. The barrier valve is run in the closed position shown in FIG. 5. As seen in FIG. 6, a tubular string 36 has a hanger 38 and a telescoping space out joint (TSOJ) 40. A shifting tool 42 engages a sleeve 44 on the barrier valve 34 to shift the sleeve 44 from the closed position in FIG. 6 to the open position in FIG. 7. A gripping dog or dogs 50 has a gripping surface 52 oriented toward the tubular 53 that forms a part of the TSOJ 40. Dog 50 is in a carrier 55 shown in FIG. 9. Carrier 55 is also a piston that responds to pressure delivered into control line 60 and then through a check valve 62. Looking at FIG. 8 there are two diameters 46 and 48 which can interact with the dog 50. When the dog is aligned with the larger diameter 46 it cannot grab the tubular 53. However, when the piston that acts as a carrier 55 for the dog 50 shifts up to align the dog 50 with the smaller diameter 48 the result is that the dog 50 bites the tubular 53 for an engagement that leads to tandem movement with the rising piston that acts as carrier 55 for the dog 50. FIG. 6 shows the hanger 38 being delivered and in FIG. 7 the hanger 38 is set to the casing. Importantly, in FIG. 7 the hanger 38 has not had to be unset, as in the prior art FIG. 4 to get the sleeve 34 to go to the closed position of FIG. 8 by virtue of upward movement of the shifting tool 42 that is latched to sleeve 44.

Figure 8:
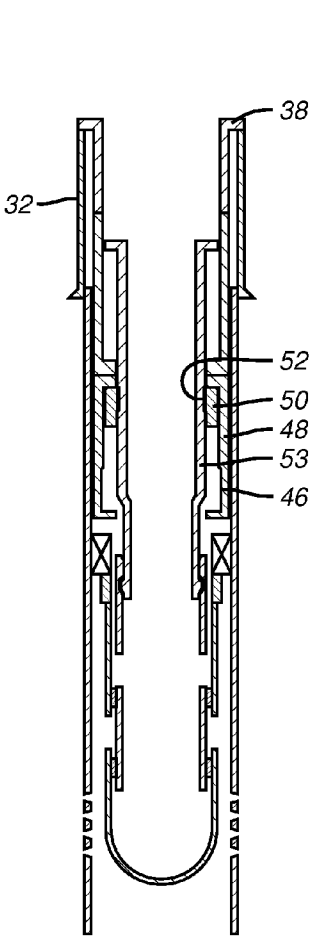
FIG. 8 is the view of FIG. 7 with the barrier valve closed but the hanger still set.
Figure 7:
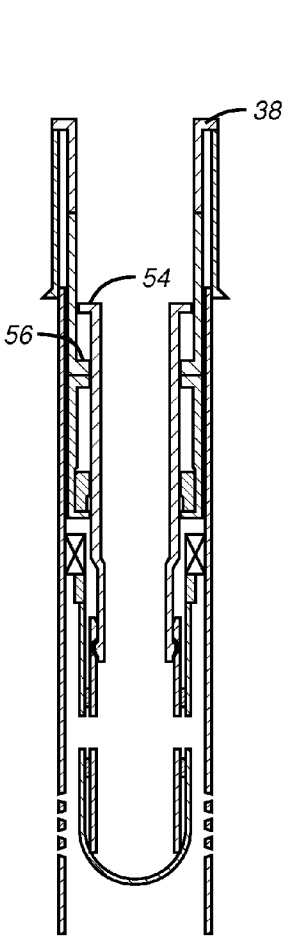
FIG. 7 is the view of FIG. 6 with the liner hanger set and the barrier valve open.
Figure 9:
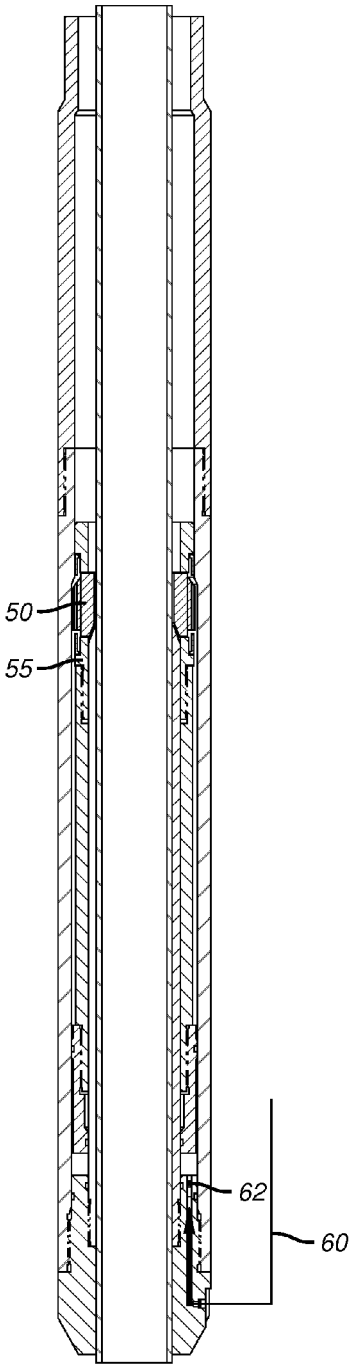
FIG. 9 is detailed view of the lifting piston in the run in position.

Instead, hydraulic pressure delivered into line 60 moves up the carrier 55 with the dog 50 until the dog 50 is cammed radially inwardly as a result of the tapered transition between the diameters 46 and 48. This inward camming then has the tubular 53 moving in tandem with the carrier 55 as radial surfaces 54 and 56 move away from each other. It should be noted that during running in the surfaces 54 and 56 are together due to the tubing weight that supports the shifting tool 42 at its lower end. The TSOJ 40 allows the surface 54 to space apart from surface 56 as the hanger 38 is properly located and set as shown in FIG. 7. With the TSOJ 40 the length of the tubular 53 does not have to be exact to locate the shifting tool 42 in the shifting groove that is in the sleeve 44. With the control line driven carrier 55 that moves the dog 50 into a biting orientation with the tubular 53 for tandem movement, the sleeve 44 can be shifted with the shifting tool 42 that moves up with the tubular 53 while the hanger 38 stays set. As seen in FIG. 8 the surfaces 54 and 56 further separate as the barrier valve opens so that there is always control if there is a well kick before the barrier valve 34 is closed, unlike the situation in FIGS. 1-4.

Figure 10:
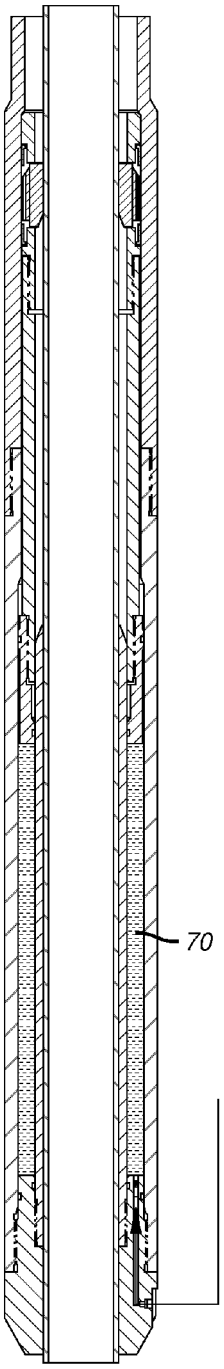
FIG. 10 is the view of FIG. 9 with the piston raised to lift the tubular.
Figure 11:
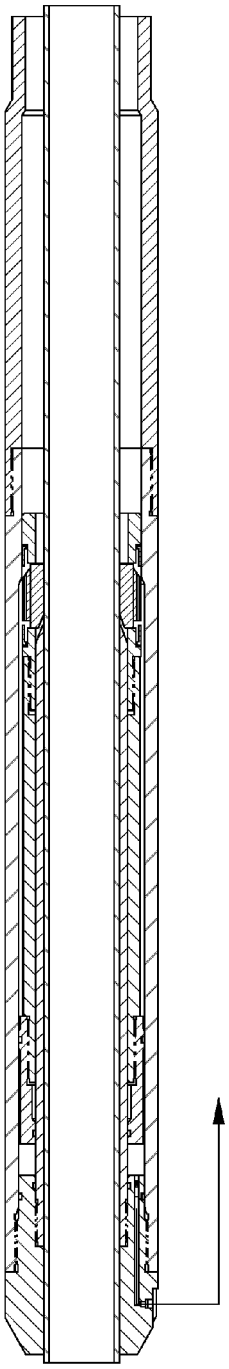
FIG. 11 is the view of FIG. 10 with control pressure vented so that the run in position is assumed.

It should be noted that application and holding pressure in control line 60 will result in the carrier 55 moving up and staying up. The check valve 62 is designed to prevent fluid leaving the cylinder 70 until the line pressure in the control line 60 is dropped to a predetermined level below the pressure in the cylinder 70. At that time the pressure will bleed off from the cylinder 70 and the dog 50 will descend as shown by comparing FIGS. 10 and 11. The descending of dog 50 also allows the gripping teeth 52 to release the tubular 53. As a result of the weight of the tubular 53 can act on the sleeve 44 to lower it and reopen the barrier valve 34. The lowered control line pressure also helps to move down the tubular 53 as long as the dog 50 is still gripping the tubular 53. After a predetermined amount of descent of the tubular 53, the dog 50 no longer bites the tubular 53 and the weight of the tubular 53 is then the exclusive force to bring down the tubular 53 and with it sleeve 44. Preferably the check valve 62 will not dump pressure until the differential pressure across it reaches about 5000 PSIG. Other differential pressures for the pressure dumping feature can be selected without departing from the scope of the invention.

Should the control line 60 rupture then the annulus pressure will reach the piston on its underside through the check valve 62. If this happens as the tubing 53 is already lifted, there is no pressure differential on the piston that is the carrier 55 for the dog 50. This is because the back side of the piston that is the carrier 55 for the dog 50 is referenced to annulus pressure on both sides. Tubing weight of tubing 53 will add pressure in chamber 70 against the check valve 62 until a differential builds that can cause the check valve 62 to vent fluid into the annulus. This may not actually happen and the tubing 53 could remain in the up position that it was in when the control line 60 failed. Weight can be set down on tubular 53 to get it to move further down. This setting down weight could then increase the pressure differential on the check valve 62 to the point that it dumps fluid from the cylinder 70. After this happens, further lifting of the tubing 53 can occur with pressure cycles of annulus pressure that now communicates through the check valve 62 as the control line 60 has ruptured or otherwise failed. The cycling of applying and removing pressure then raises the tubular 53 incrementally as delivered pressure stays trapped by the check valve 62 after each cycle. On the other hand, if control line 60 fails when in the FIG. 6 all the way down position, then nothing happens. The tubular 53 could be lifted with cycles of application and removal of annulus pressure that make the carrier 55 go up using unequal piston areas exposed to rising annulus pressure. Sometimes the annulus can have heavy fluid and if this is known in advance then the differential pressure at which the check valve 62 dumps pressure can be adjusted.

Those skilled in the art will appreciate that a variety of tools can be ultimately operated when the bottom hole assembly has a TSOJ 40. The invention allows such operation without having a need to release a safety device such as a hanger. The fully stroked position can be held with maintenance of control line pressure and the movement can be reversed with lowering of control line pressure to get a sufficient differential on the check valve to cause it to work as a pressure venting valve to allow downward movement on the tool being operated.

The above description is illustrative of the preferred embodiment and many modifications may be made by those skilled in the art without departing from the invention whose scope is to be determined from the literal and equivalent scope of the claims below:

We claim:

1. An assembly for operating a subterranean tool, comprising:

a tubular string comprising a telescoping space out joint (TSOJ), a well control device and an operator for operably engaging the subterranean tool;

said TSOJ remotely operable to move with respect to said string for operation of the subterranean tool with said well control device being fully functional.

2. The assembly of claim 1, wherein:

said TSOJ comprises at least one dog that selectively grips a movably mounted tubular for movement relative to said tubular string.

3. The assembly of claim 2, wherein:

said TSOJ is remotely actuated to move in opposed directions relative to said tubular string.

4. The assembly of claim 3, wherein:

said TSOJ further comprises at least one hydraulically driven dog that engages a tubular of the TSOJ during a partial amount the travel of the tubular.

5. The assembly of claim 4, wherein:

said TSOJ further comprises at least one hydraulically driven dog where hydraulic pressure through a check valve moves said dog in a first direction as pressure builds in a cylinder with said check valve selectively retaining cylinder pressure.

6. The assembly of claim 5, wherein:

said check valve releases pressure from said cylinder at a differential pressure across said check valve of a predetermined value.

7. The assembly of claim 5, wherein:

said well control device comprises a hanger.

8. The assembly of claim 5, wherein:

said operator comprises a shifting tool that selectively moves a sleeve in the subterranean tool.

9. The assembly of claim 1, wherein:

said TSOJ is remotely actuated to move in opposed directions relative to said tubular string.

10. The assembly of claim 1, wherein:

said TSOJ further comprises at least one hydraulically driven dog that engages a tubular of the TSOJ during a partial amount of the travel of the tubular.

11. The assembly of claim 1, wherein:

said TSOJ further comprises at least one hydraulically driven dog where hydraulic pressure through a check valve moves said dog in a first direction as pressure builds in a cylinder with said check valve selectively retaining cylinder pressure.

12. The assembly of claim 11, wherein:

said check valve releases pressure from said cylinder at a differential pressure across said check valve of a predetermined value.

13. The assembly of claim 1, wherein:

said well control device comprises a hanger.

14. The assembly of claim 1, wherein:

said operator comprises a shifting tool that selectively moves a sleeve in the subterranean tool.

15. A method of operating a subterranean tool, comprising:

running in a string with a telescoping space out joint (TSOJ) that further comprises a tubular that selectively operates the subterranean tool;

providing an actuation system with said TSOJ to selectively move said tubular relative to said string without moving said string to operate the subterranean tool.

16. The method of claim 15, comprising:

retaining a safety device mounted to said string in operating condition while moving said tubular to operate the subterranean tool.

17. The method of claim 15, comprising:

using at least one piston driven dog in said actuation system where said dog engages the tubular after initial movement without engaging the tubular.

18. The method of claim 15, comprising:

retaining initial tubular movement with a check valve that selectively allows return movement of said tubular responsive to pressure differential on said check valve reaching a predetermined value.

19. The method of claim 18, comprising:

allowing said check valve to release pressure by dropping applied pressure in a control line in fluid communication with said check valve.

20. The method of claim 15, comprising:

using annulus pressure to operate said actuating system as an alternative to a control line.

* * * * *